US012342926B1

(12) United States Patent
Cote

(10) Patent No.: US 12,342,926 B1
(45) Date of Patent: Jul. 1, 2025

(54) MODULAR BACKPACK AND HARNESS SYSTEM

(71) Applicant: Alex Cote, Edmonton (CA)

(72) Inventor: Alex Cote, Edmonton (CA)

( * ) Notice: Subject to any disclaimer, the term of this patent is extended or adjusted under 35 U.S.C. 154(b) by 224 days.

(21) Appl. No.: 18/135,802

(22) Filed: Apr. 18, 2023

(51) Int. Cl.
*A45F 4/02* (2006.01)
*A45F 4/00* (2006.01)
*A47D 13/02* (2006.01)

(52) U.S. Cl.
CPC ..... *A45F 4/02* (2013.01); *A47D 13/025* (2013.01); *A45F 2004/006* (2013.01); *A45F 2004/026* (2013.01)

(58) Field of Classification Search
CPC ..... A45F 4/02; A47D 13/025
See application file for complete search history.

(56) References Cited

U.S. PATENT DOCUMENTS

| | | | | |
|---|---|---|---|---|
| D418,673 | S | 1/2000 | Madsen | |
| 8,919,628 | B2 | 12/2014 | Jamlang | |
| 9,232,848 | B2 * | 1/2016 | Krikorian | A45F 3/08 |
| 10,051,945 | B1 | 8/2018 | Pomare | |
| D866,166 | S | 11/2019 | Ho | |
| 11,026,501 | B1 * | 6/2021 | Dabrowka | F41H 1/02 |
| 2007/0228091 | A1 | 10/2007 | Shawen | |
| 2009/0127299 | A1 * | 5/2009 | Jamlang | A45F 3/14 224/153 |
| 2009/0139814 | A1 * | 6/2009 | Grossman | A45F 3/04 190/115 |
| 2012/0292355 | A1 | 11/2012 | Olson | |
| 2015/0076182 | A1 * | 3/2015 | Coleman | A45F 4/02 224/155 |
| 2015/0201761 | A1 | 7/2015 | Wollenberg | |
| 2016/0235173 | A1 * | 8/2016 | Davis | A45F 3/08 |
| 2017/0000243 | A1 * | 1/2017 | Seuk | A45F 4/02 |
| 2018/0008024 | A1 * | 1/2018 | Barton | A45F 3/04 |
| 2019/0059563 | A1 * | 2/2019 | Logan | A45C 5/141 |
| 2019/0074489 | A1 * | 3/2019 | Yamaoka | A45F 3/10 |
| 2019/0166981 | A1 * | 6/2019 | Revels | A45F 3/10 |
| 2019/0343266 | A1 * | 11/2019 | Parekh | A45F 3/047 |
| 2020/0107622 | A1 * | 4/2020 | Tedesco | A45F 4/02 |
| 2020/0187629 | A1 * | 6/2020 | Sniffen | A45C 7/0086 |
| 2020/0214407 | A1 * | 7/2020 | Nichols | A45C 13/1084 |
| 2020/0228056 | A1 | 7/2020 | Miller | |
| 2020/0229580 | A1 * | 7/2020 | Cigard | A45F 3/04 |
| 2020/0288849 | A1 | 9/2020 | Bookris | |

(Continued)

FOREIGN PATENT DOCUMENTS

| | | |
|---|---|---|
| WO | 2015112546 | 7/2015 |

*Primary Examiner* — Brian D Nash

(57) ABSTRACT

The modular backpack and harness system is a modular backpack. The modular backpack and harness system is interchangeable such that the modular backpack and harness system can be adjusted to the cargo being carried by the modular backpack and harness system. The modular backpack and harness system incorporates a harness structure and a plurality of cargo structures. Each cargo structure selected from the plurality of cargo structures removably attaches to the harness structure. The plurality of cargo structures are interchangeable. The difference between any first cargo structure selected from the plurality of cargo structures and any second cargo structure selected from the plurality of cargo structures is the cargo the selected cargo structures are configured to carry.

11 Claims, 8 Drawing Sheets

(56) References Cited

U.S. PATENT DOCUMENTS

| | | | | |
|---|---|---|---|---|
| 2022/0079311 | A1* | 3/2022 | Logan | A45F 3/04 |
| 2022/0175119 | A1* | 6/2022 | Webb | A45F 3/047 |
| 2023/0404242 | A1* | 12/2023 | Waggoner | A45F 3/04 |
| 2024/0292940 | A1* | 9/2024 | Tesche | A45F 4/02 |

* cited by examiner

MODULAR BACKPACK AND HARNESS SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of pack-frames carried on the body. (A45F3/10)

SUMMARY OF INVENTION

The modular backpack and harness system is a luggage item. The modular backpack and harness system is a backpack. The modular backpack and harness system is a modular system. The modular backpack and harness system is interchangeable such that the modular backpack and harness system can be adjusted to the cargo being carried by the modular backpack and harness system. The modular backpack and harness system comprises a harness structure and a plurality of cargo structures. Each cargo structure selected from the plurality of cargo structures removably attaches to the harness structure. The plurality of cargo structures are interchangeable. By interchangeable is meant that any first cargo structure selected from the plurality of cargo structures can be replaced by any second cargo structure selected from the plurality of cargo structures. The difference between any first cargo structure selected from the plurality of cargo structures and any second cargo structure selected from the plurality of cargo structures is the cargo the selected cargo structures are configured to carry.

These together with additional objects, features and advantages of the modular backpack and harness system will be readily apparent to those of ordinary skill in the art upon reading the following detailed description of the presently preferred, but nonetheless illustrative, embodiments when taken in conjunction with the accompanying drawings.

In this respect, before explaining the current embodiments of the modular backpack and harness system in detail, it is to be understood that the modular backpack and harness system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the modular backpack and harness system.

It is therefore important that the claims be regarded as including such equivalent construction insofar as they do not depart from the spirit and scope of the modular backpack and harness system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
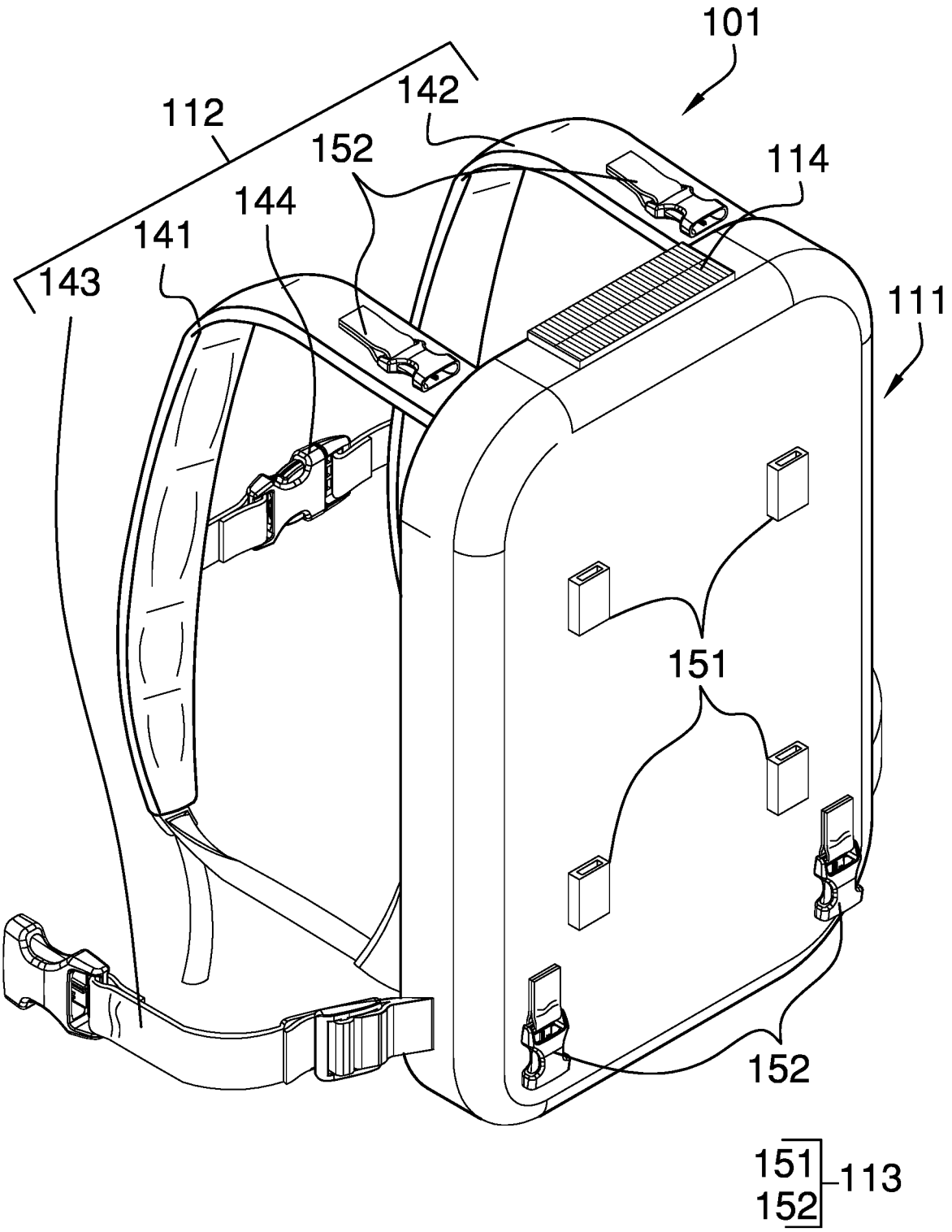
FIG. 1 is an anterior view of an embodiment of the disclosure.
Figure 2:
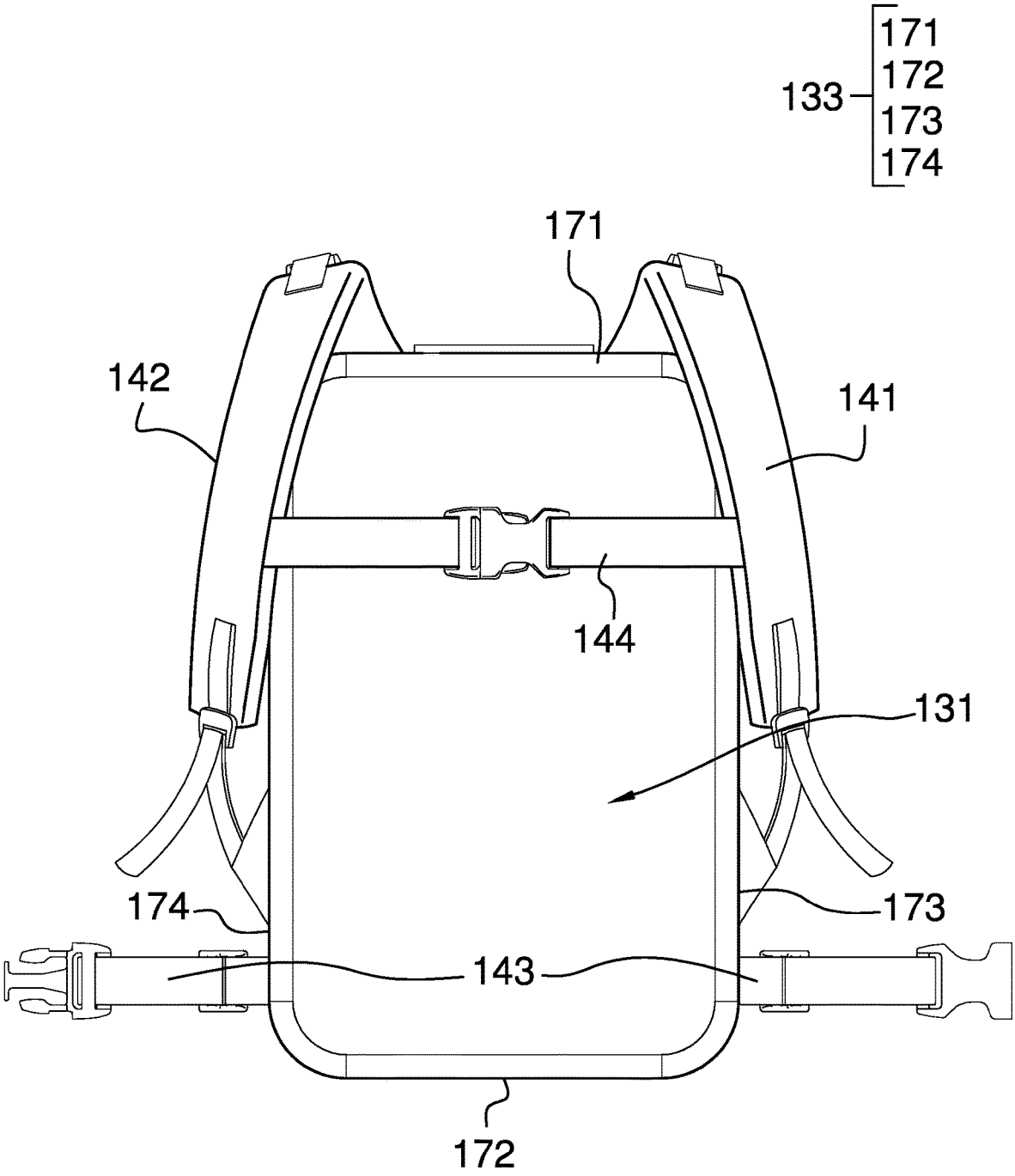
FIG. 2 is a posterior view of an embodiment of the disclosure.
Figure 3:
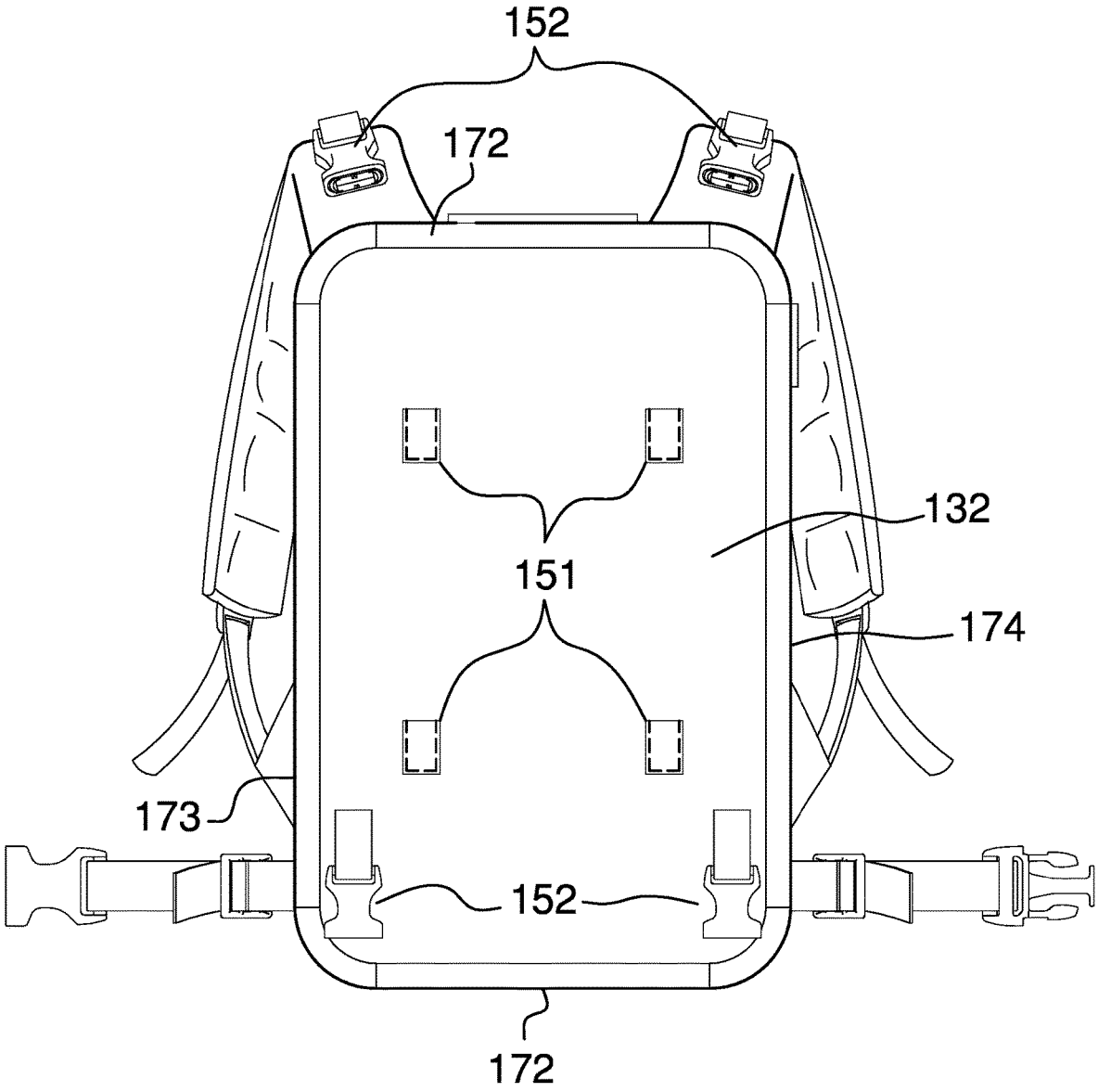
FIG. 3 is an in-use view of an embodiment of the disclosure.
Figure 4:
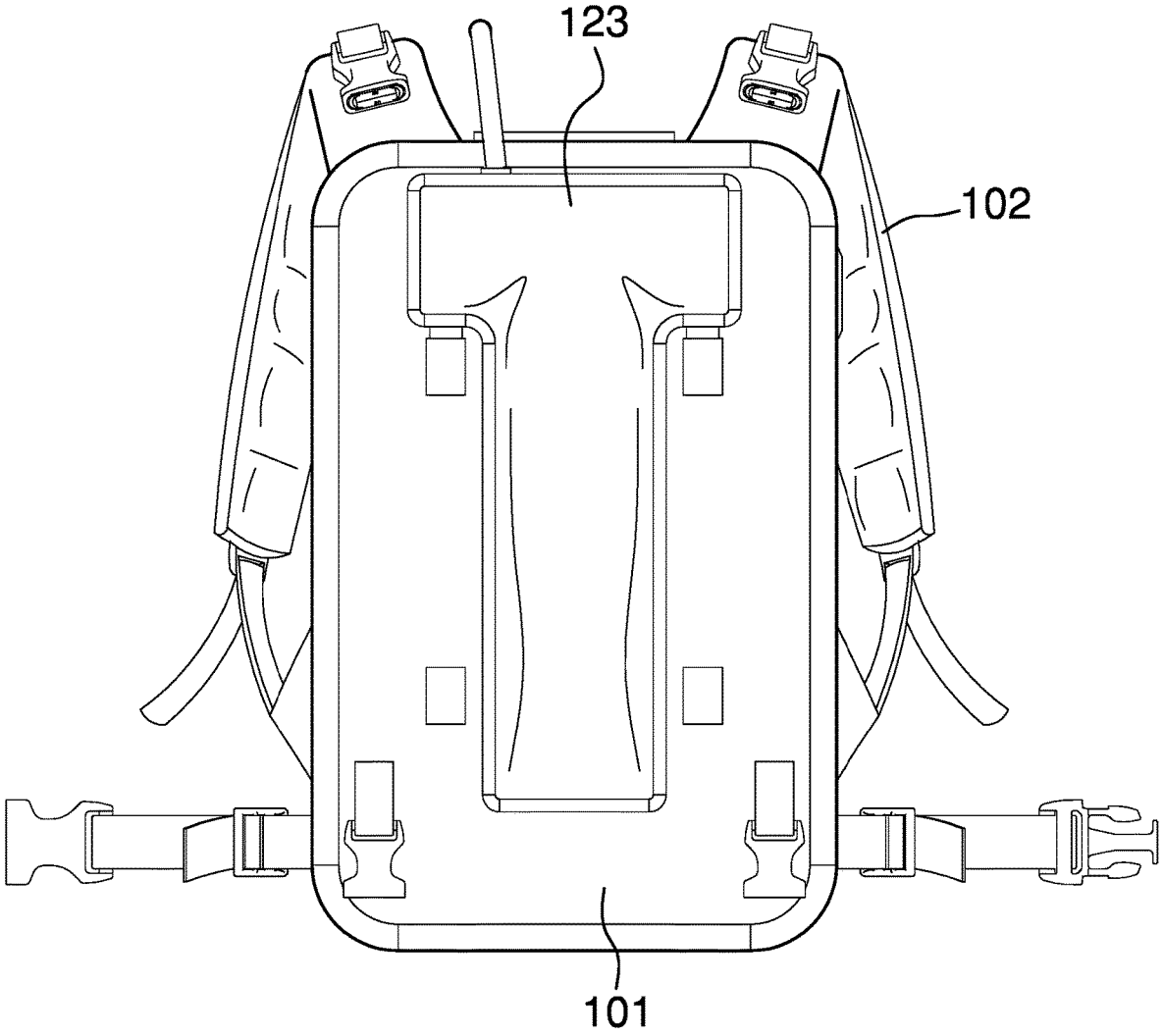
FIG. 4 is an in-use view of an embodiment of the disclosure.
Figure 5:
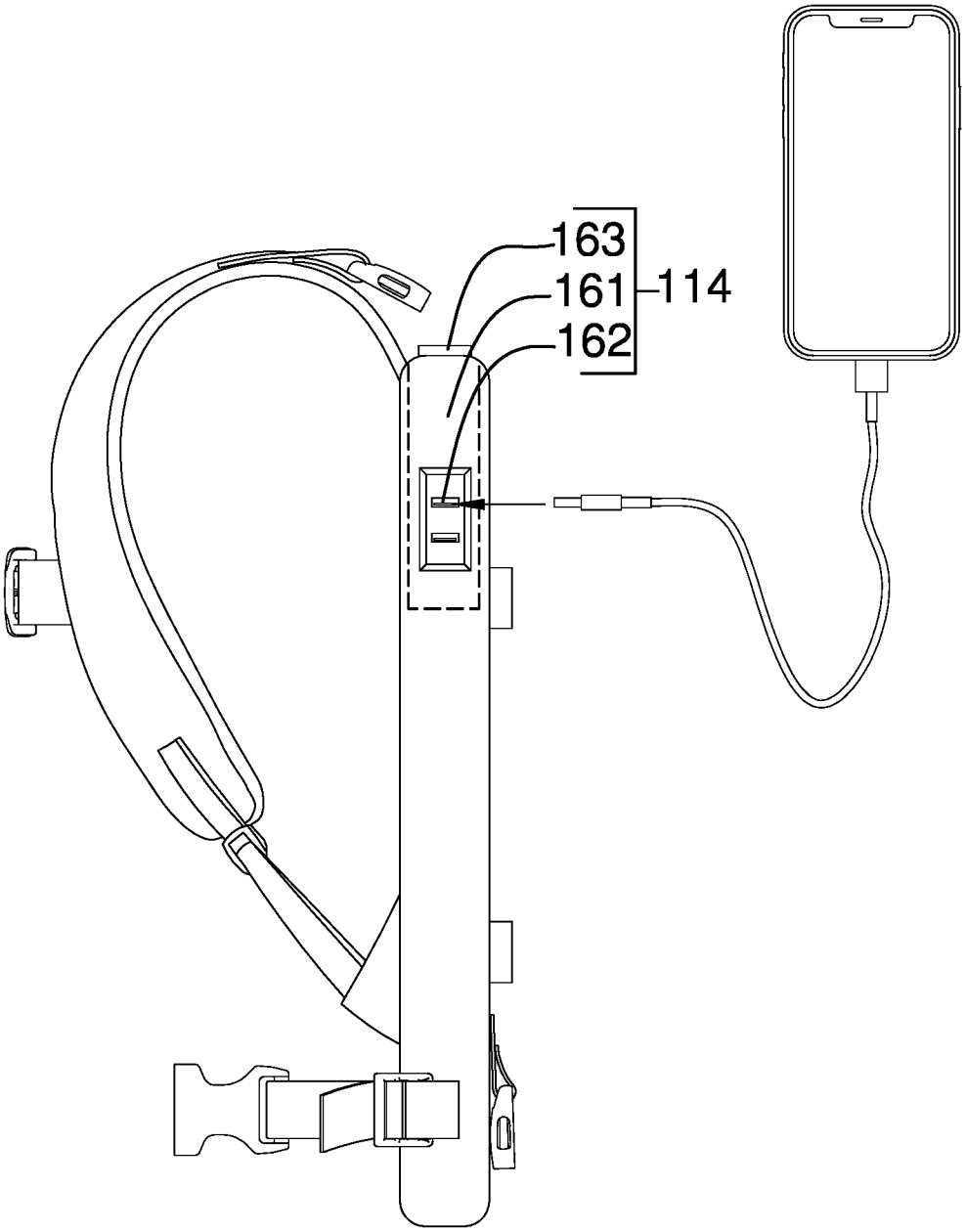
FIG. 5 is a side view of an embodiment of the disclosure.
Figure 6:
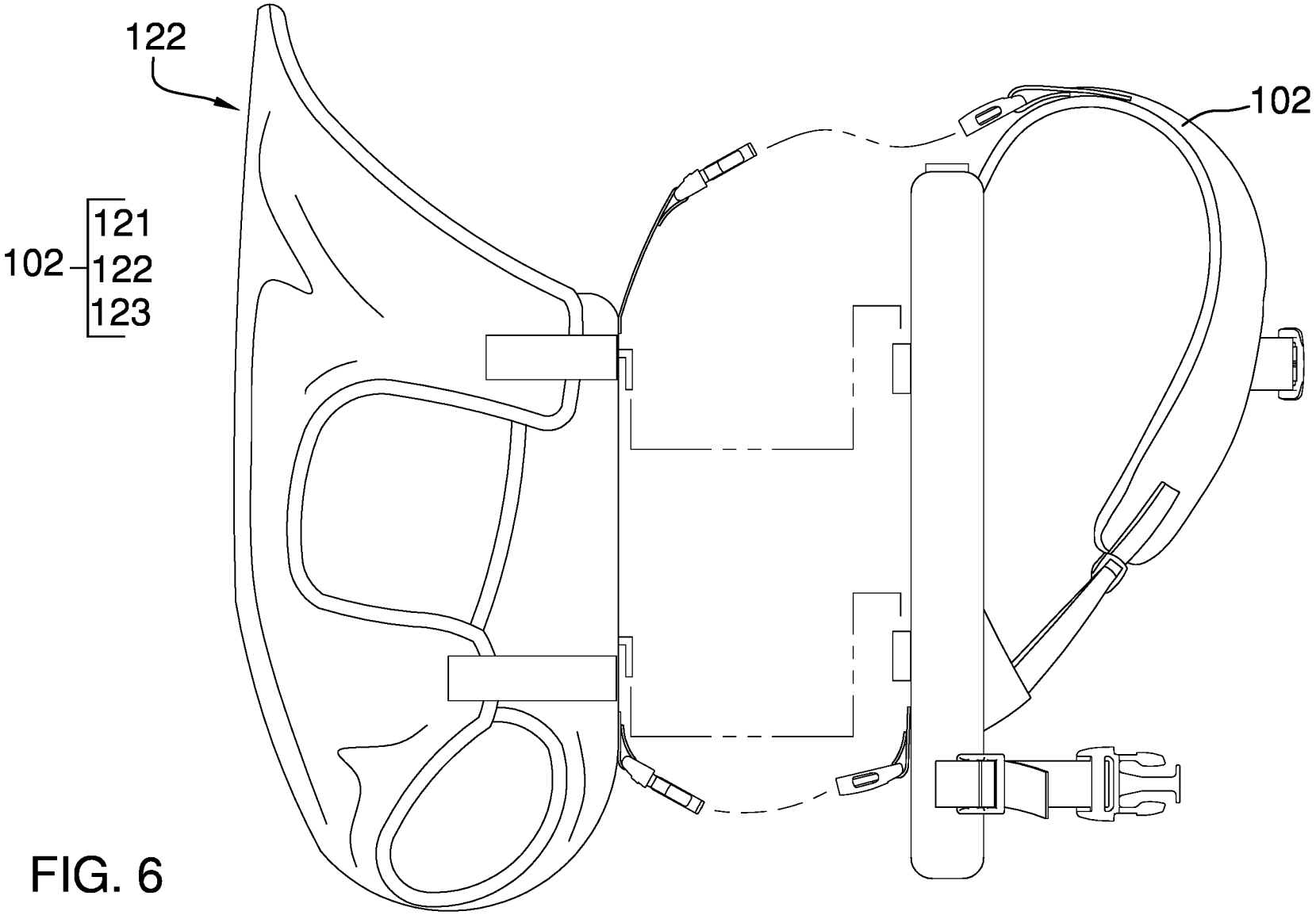
FIG. 6 is an in-use view of an embodiment of the disclosure.
Figure 7:
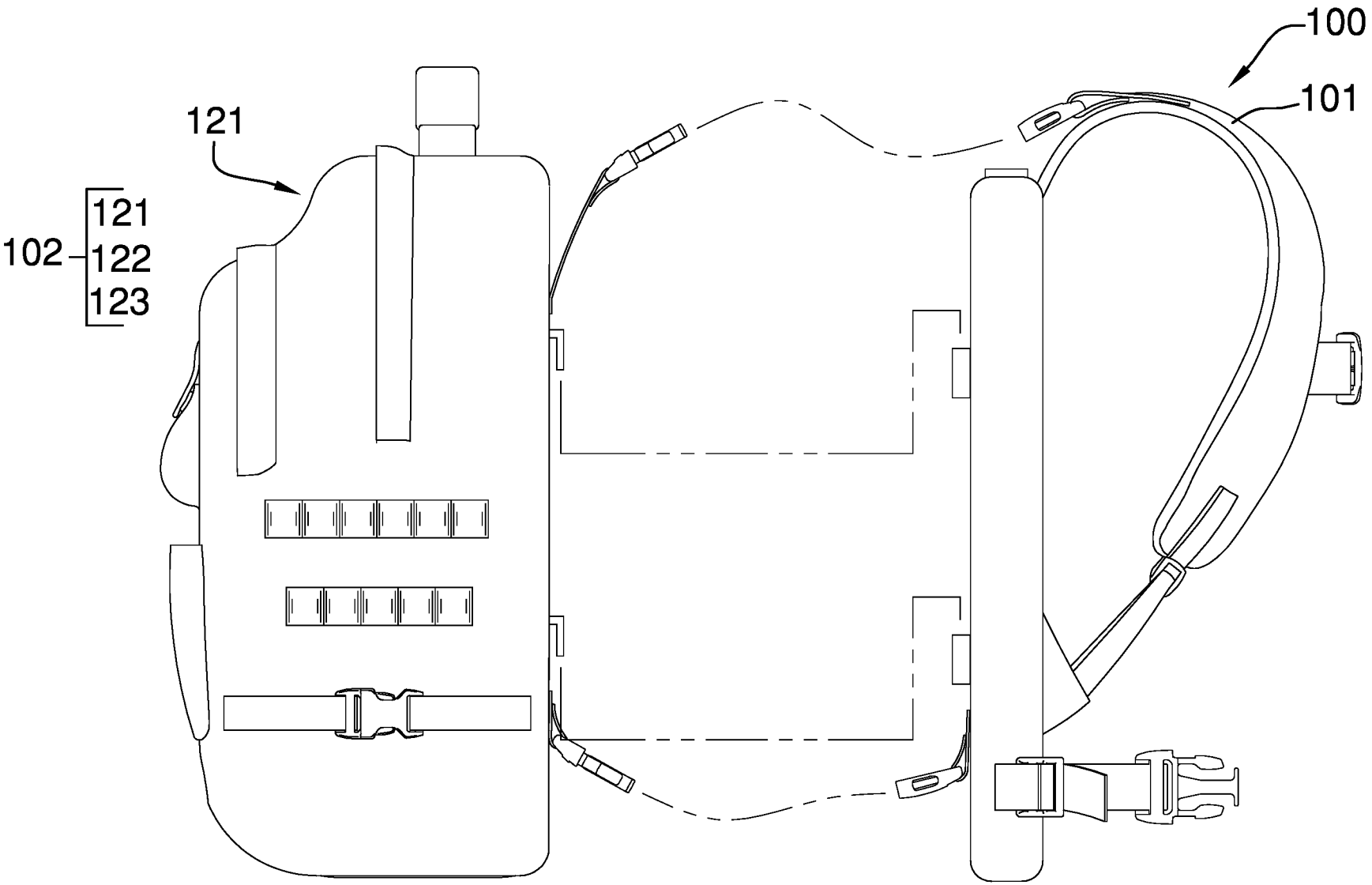
FIG. 7 is an in-use view of an embodiment of the disclosure.
Figure 8:
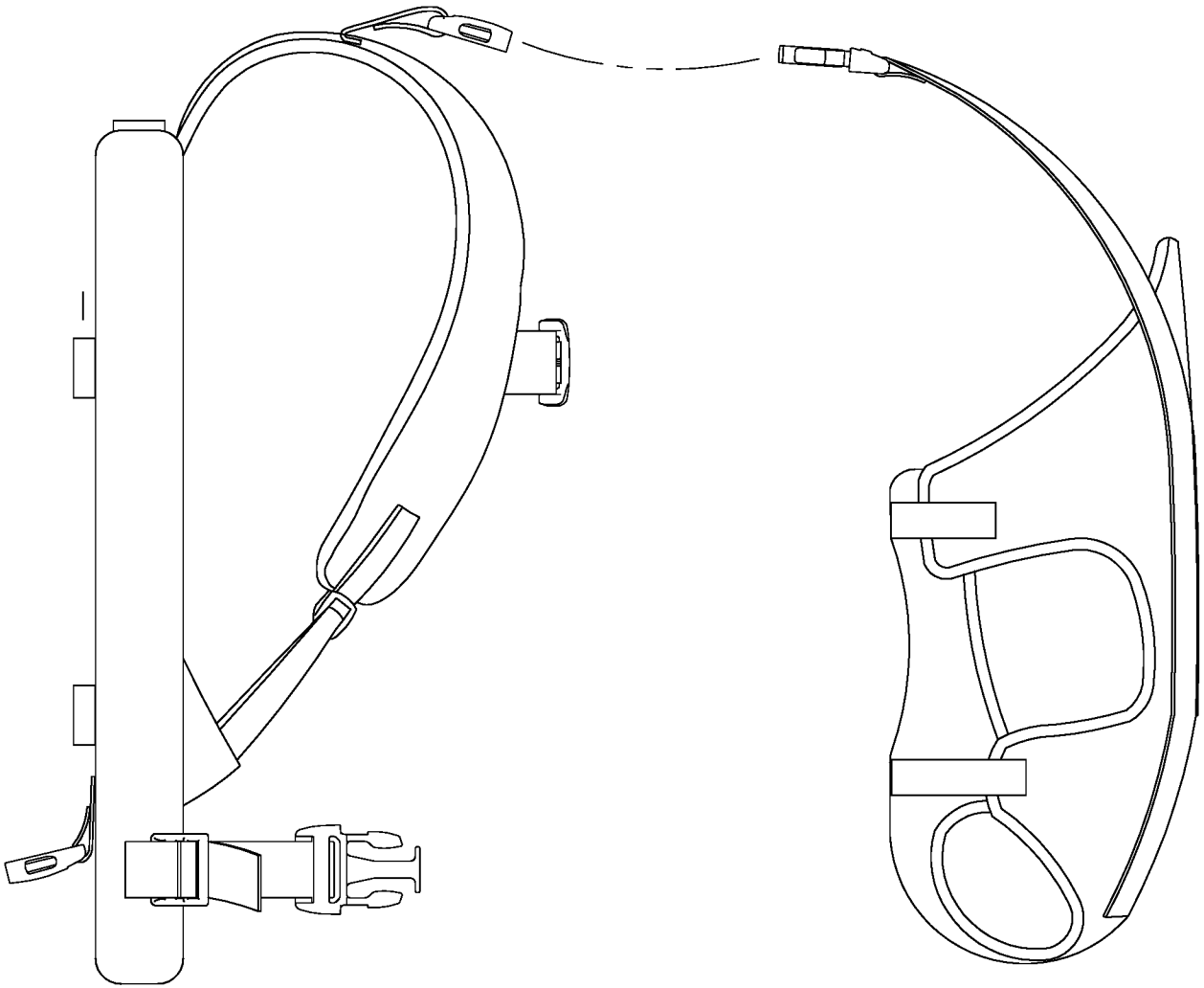
FIG. 8 is an in-use view of an embodiment of the disclosure.

Detailed reference will now be made to one or more potential embodiments of the disclosure, which are illustrated in FIGS. 1 through 8.

The modular backpack and harness system 100 (hereinafter invention) is a luggage item. The invention 100 is a backpack. The invention 100 is a modular system. The invention 100 is interchangeable such that the invention 100 can be adjusted to the cargo being carried by the invention 100. The invention 100 comprises a harness structure 101 and a plurality of cargo structures 102. Each cargo structure selected from the plurality of cargo structures 102 removably attaches to the harness structure 101. The plurality of cargo structures 102 are interchangeable. By interchangeable is meant that any first cargo structure selected from the plurality of cargo structures 102 can be replaced by any second cargo structure selected from the plurality of cargo structures 102. The difference between any first cargo structure selected from the plurality of cargo structures 102 and any second cargo structure selected from the plurality of cargo structures 102 is the cargo the selected cargo structures are configured to carry.

The harness structure 101 is a load bearing structure. The harness structure 101 is a worn structure. The harness structure 101 is worn on the back of an individual using the invention 100. Each cargo structure selected from the plurality of cargo structures 102 removably attaches to the harness structure 101. Each selected cargo structure attaches to the harness structure 101 such that the harness structure 101 is positioned between the back of the individual using the invention 100 and the selected cargo structure. The harness structure 101 transfers the load of the selected cargo structure to an individual using the invention 100. The harness structure 101 comprises a harness plate structure 111, a shoulder harness structure 112, a plurality of attachment structures 113, and a battery 161 circuit 114.

The harness plate structure 111 is a rigid structure. The harness plate structure 111 is a disk shaped structure. The shoulder harness structure 112 attaches to the harness plate structure 111. A subset of the plurality of attachment structures 113 attaches to the harness plate structure 111. The battery 161 circuit 114 mounts inside the harness plate structure 111. Any cargo structure selected from the plurality of cargo structures 102 used by the individual using the invention 100 attaches to the harness plate structure 111. The harness plate structure 111 comprises an anterior face 131, a posterior face 132, and a plurality of lateral faces 133.

The anterior face 131 forms a congruent end of the disk structure of the harness plate structure 111. The anterior face 131 is the face of the disk structure of the harness plate structure 111 with the greatest surface area. The anterior face 131 is the face of the disk structure of the harness plate structure 111 that is proximal to the individual using the invention 100. The shoulder harness structure 112 attaches to the anterior face 131 of the harness plate structure 111.

The posterior face 132 forms a congruent end of the disk structure of the harness plate structure 111. The posterior face 132 is the face of the disk structure of the harness plate structure 111 that is distal from the anterior face 131. The posterior face 132 forms the surface of the harness plate structure 111 that any cargo structure selected from the 8 plurality of cargo structures 102 attaches to. A subset of the plurality of attachment structures 113 attaches to the posterior face 132 of the harness plate structure 111.

The plurality of lateral faces 133 form the lateral face structure of the disk structure of the harness plate structure 111. The plurality of lateral faces 133 further comprises a superior lateral face 171, an inferior lateral face 172, a left lateral face 173, and a right lateral face 174.

The superior lateral face 171 is the horizontally oriented lateral face of the harness plate structure 111 that forms the superior surface of the harness plate structure 111 when the individual using the invention 100 wears the harness structure 101 normally. The inferior lateral face 172 is the horizontally oriented lateral face of the harness plate structure 111 that is distal from the superior lateral face 171. The left lateral face 173 is the vertically oriented lateral face of the harness plate structure 111 that is proximal to the left side of the individual using the invention 100 when the harness structure 101 is worn normally. The right lateral face 174 is the vertically oriented lateral face of the harness plate structure 111 that is distal from the individual using the invention 100.

The shoulder harness structure 112 is a harness. The shoulder harness structure 112 attaches to the anterior face 131 of the harness plate structure 111. The shoulder harness structure 112 secures the harness plate structure 111 to the individual using the invention 100 such that the anterior face 131 of the harness plate structure 111 is proximal to the individual using the invention 100. A subset of the plurality of attachment structures 113 further attaches to the shoulder harness structure 112. The shoulder harness structure 112 comprises a left shoulder strap 141, a right shoulder strap 142, a waist strap 143, and a chest strap 144.

The left shoulder strap 141 is a shoulder strap. The shoulder strap is defined elsewhere in this disclosure. The left shoulder strap 141 secures the harness structure 101 to the left shoulder of the individual using the invention 100. The right shoulder strap 142 is a shoulder strap. The shoulder strap is defined elsewhere in this disclosure. The right shoulder strap 142 secures the harness structure 101 to the right shoulder of the individual using the invention 100. The waist strap 143 is a strap. The waist strap 143 binds the harness structure 101 to the waist of the individual using the invention 100. The chest strap 144 is a strap. The chest strap 144 binds the harness structure 101 to the chest of the individual using the invention 100.

The plurality of attachment structures 113 combine to form a fastening device. The plurality of attachment structures 113 removably attaches any cargo structure selected from the plurality of cargo structures 102 to the harness plate structure 111 and the shoulder harness structure 112. A subset of the plurality of attachment structures 113 attaches to the posterior face 132 of the harness plate structure 111. The balance of the plurality of attachment structures 113 attaches to a shoulder harness selected from the group consisting of: a) the left shoulder strap 141; and, b) the right shoulder strap 142. The plurality of attachment structures 113 comprises a plurality of latch structures 151 and a plurality of quick release buckles 152.

The plurality of latch structures 151 is a fastening device. The plurality of latch structures 151 comprises a plurality of latch devices. The plurality of latch structures 151 mount on the posterior face 132 of the harness plate structure 111. The plurality of latch structures 151 removably attach any cargo structure selected from the plurality of cargo structures 102 to the posterior face 132 of the harness plate structure 111.

The plurality of quick release buckles 152 is a fastening device. The plurality of quick release buckles 152 comprises a plurality of quick release buckles. A subset of the plurality of quick release buckles 152 attach to the shoulder harness structure 112. The balance of the plurality of quick release buckles 152 attach to the posterior face 132 of the harness plate structure 111. The plurality of quick release buckles 152 removably attach any cargo structure selected from the plurality of cargo structures 102 to the posterior face 132 of the harness plate structure 111.

The battery 161 circuit 114 is an electric circuit. The battery 161 circuit 114 is an electrochemical device. The battery 161 circuit 114 stores chemical potential energy. The battery 161 circuit 114 converts the chemical potential into electrical energy that is made available to the personal data device of the individual using the invention 100. The battery 161 circuit 114 is an independently powered electric circuit. By independently powered is meant that the battery 161 circuit 114 can operate without an electrical connection to an external power source. The battery 161 circuit 114 comprises a battery 161, a charging port 162, and a photovoltaic cell 163. The battery 161, the charging port 162, and the photovoltaic cell 163 are electrically interconnected.

The battery 161 mounts in the interior of the harness plate structure 111. The charging port 162 mounts in the left lateral face 173 of the plurality of lateral faces 133 of the harness plate structure 111. The photovoltaic cell 163 mounts in the superior lateral face 171 of the plurality of lateral faces 133 of the harness plate structure 111.

The battery 161 is an electrochemical device. The battery 161 converts chemical potential energy into the electrical energy used to power the battery 161 circuit 114. The battery 161 is a commercially available rechargeable battery 161. The photovoltaic cell 163 is an electrical device that converts light into electrical energy. The chemical energy stored within the rechargeable battery 161 is further renewed and restored through use of the photovoltaic cell 163. The photovoltaic cell 163 is directly wired to the battery 161. The photovoltaic cell 163 is an electrical circuit that reverses the polarity of the rechargeable battery 161 and provides the energy necessary to reverse the chemical processes that the rechargeable battery 161 initially used to generate the electrical energy. This reversal of the chemical process creates a chemical potential energy that will later be used by the rechargeable battery 161 to generate electricity.

The charging port 162 is an electrical circuit. The charging port 162 powers the operation of a charging port 162. The charging port 162 is an electric port. The charging port 162 transfers electric energy from the battery 161 to a personal data device.

Each cargo structure selected from the plurality of cargo structures 102 is a load bearing structure. The selected cargo structure is configured to carry a specific cargo. The plurality of cargo structures 102 comprises a portage structure 121, a child seat structure 122, and a reservoir structure 123.

The portage structure 121 is a cargo structure selected from the plurality of cargo structures 102. The portage structure 121 is formed as a container. The portage structure 121 is configured to carry portable domestic articles.

The child seat structure 122 is a cargo structure selected from the plurality of cargo structures 102. The child seat structure 122 is formed as a seat. The child seat structure 122 is adapted for use in carrying a child.

The reservoir structure 123 is a cargo structure selected from the plurality of cargo structures 102. The reservoir structure 123 is formed as a bladder. The reservoir structure 123 is configured for use in carrying drinking water.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

Backpack: As used in this disclosure, a backpack is an item of luggage that comprises a harness arrangement that allows the backpack to be carried on the back of a user. The harness arrangement commonly comprises a plurality of shoulder straps. A book bag is considered a backpack under this definition.

Barrier: As used in this disclosure, a barrier is a physical obstacle that forms a boundary between a first space and a second space. The barrier prevents the passage of an object between the first space and the second space.

Battery: As used in this disclosure, a battery is a chemical device consisting of one or more cells, in which chemical energy is converted into electricity and used as a source of power. Batteries are commonly defined with a positive terminal and a negative terminal.

Bladder: As used in this disclosure, a bladder is fluid impermeable structure. The internal volume of the structure can be varied by: a) varying the pressure and/or quantity of a fluid contained within the bladder; or b) varying the quantity of a liquid contained within the bladder. Bladders are commonly used for storage of a fluid and as a cushion.

Buckle: As used in this disclosure, a buckle is a fastening device that is used for joining a first free end of a strap to a second free end of the same strap or a different strap. A buckle further comprises a first (also called the male) connector that is attached to the first free end and a second (also called the female) connector that is attached to the second free end. The male connector has a pin or other structure that is generally caught by a structure formed in the female connector.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Control Circuit: As used in this disclosure, a control circuit is an electrical circuit that manages and regulates the behavior or operation of a device.

Correspond: As used in this disclosure, the term correspond is used as a comparison between two or more objects wherein one or more properties shared by the two or more objects match, agree, or align within acceptable manufacturing tolerances.

Diode: As used in this disclosure, a diode is a two terminal semiconductor device that allows current flow in only one direction. The two terminals are called the anode and the cathode. Electric current is allowed to pass from the anode to the cathode.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Domestic Article: As used in this disclosure, a domestic article is an item or object: 1) that is commonly found within a household; or, 2) that is commonly carried or worn by a person. Examples of domestic articles include, but are not limited to, furniture, kitchen appliances, clothing, keys and key fobs, personal data devices, glasses, remote controls, or personal storage items such as purses, briefcases, wallets, or cases.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

External Power Source: As used in this disclosure, an external power source is a source of the energy that is externally provided to enable the operation of the present disclosure. Examples of external power sources include, but are not limited to, electrical power sources and compressed air sources.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Harness: As used in this disclosure, a harness is an apparatus comprising a plurality of straps and one or more fasteners that is used to fasten or anchor a first person or first object to a second object. The phrase N point harness refers to the installation of the harness wherein the harness has N anchor points. For example, a 2 point harness has two anchor points while a 5 point harness has 5 anchor points.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interchangeable: As used in this disclosure, interchangeable refers to the ability to remove and replace an element of a structure. For example, if a first object that is attached to a structure can be removed and replaced with a second object selected from a plurality of compatible objects than the first object is said to be replaceable with both: 1) the second object; and, 2) each of the elements of compatible objects. Term interchangeable is commonly associated with tools. Interchangeable objects are often used to change the function or the performance characteristics of a tool.

Interior: As used in this disclosure, the interior is used as a relational term that implies that an object is contained within the boundary of a structure or a space.

Latch: As used in this disclosure, a latch is a fastening or locking mechanism. The use of the term latch does not necessarily but often implies the insertion of an object into a notch or cavity.

Lateral: As used in this disclosure, the term lateral refers to the movement of an object that is perpendicular to the primary sense of direction of an object and parallel to the horizontal plane (or perpendicular to the vertical plane). Lateral movement is always perpendicular to the anterior posterior axis. Lateral movement is often called sideways movement.

Left and Right: As used in this disclosure, the terms left and right are directional references associated with an object. The object is further defined with an anterior surface and a posterior surface. The terms left and right are standardized naming conventions for the lateral directions of the object. The terms left and right use the human body for the initial definition of the orientation. Specifically, when a human body is viewed from posterior side towards the anterior side, the left side of the human body is the lateral side of the human body that contains the heart. The right side of the human body is the lateral side of the body that contains the bulk of the liver. The left and right sides of the human body remain unchanged by changes to the direction from which the human body is viewed. The left side of any object is the same side as the left side of the human body when the object is viewed from posterior side towards the anterior side. The right side of any object is the same side as the right side of the human body when the object is viewed from posterior side towards the anterior side. The left and right sides of the object remain unchanged by changes to the direction from which the object is viewed.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Luggage: As used in this disclosure, luggage is a trunk, bag, purse, parcel, suitcase, or backpack in which domestic articles are contained during travel.

Modular: As used in this disclosure, modular refers to a system of assembly of a structure from modules. Always use module.

Module: As used in this disclosure, a module refers to an independent subunit of a larger structure. Modules are often interchangeable in a manner that allows the form factor or function of the larger structure to be customized.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Plug: As used in this disclosure, a plug is an electrical termination that electrically connects a first electrical circuit to a second electrical circuit or a source of electricity. As used in this disclosure, a plug will have two or three metal pins.

Port: As used in this disclosure, a port is an electrical termination that is used to connect a first electrical circuit to a second external electrical circuit. In this disclosure, the port is designed to receive a plug.

Posterior: As used in this disclosure, posterior is a term that is used to refer to the side of an object that is distal or in the opposite direction of the anterior side. When comparing two items, the posterior item is the item that is distal from the anterior of the object.

Primary Shape: As used in this disclosure, the primary shape refers to a description of the rough overall geometric shape of an object that is assembled from multiple components or surfaces. Use Roughly Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the 23 object; c) protects the object within the protected space from potential dangers that are outside of the protected space; or, d) maintains the privacy of the object within the protected space.

Quick Release Buckle: As used in this disclosure, a quick release buckle is a specific type of buckle wherein the buckle can be readily and easily disconnected by pressing a button or pinching one of the ends of the quick release buckle.

Refillable Reservoir: As used in this disclosure, a refillable reservoir is a reservoir that is enabled with a structure that receives an externally provided fluid intended to replenish the fluid that has been removed from the reservoir. In this disclosure, a first reservoir structure that is interchangeable with a second reservoir structure would be consider refillable.

Reservoir: As used in this disclosure, a reservoir refers to a container or containment system that is configured to store a fluid.

Rigid Structure: As used in this disclosure, a rigid structure is a solid structure formed from an inelastic material that resists changes in shape. A rigid structure will permanently deform as it fails under a force. See bimodal flexible structure.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Shoulder Strap: As used in this disclosure, a shoulder strap is a strap used to suspend an object from a shoulder.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape. Strips often have a disk shape.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A modular backpack and harness system comprising a harness structure and a plurality of cargo structures;

wherein each cargo structure selected from the plurality of cargo structures removably attaches to the harness structure;

wherein the plurality of cargo structures comprises a portage structure, a child seat structure, and a reservoir structure;

wherein the portage structure is a cargo structure selected from the plurality of cargo structures;

wherein the portage structure is formed as a container;

wherein the child seat structure is a cargo structure selected from the plurality of cargo structures;

wherein the child seat structure is formed as a seat;

wherein the reservoir structure is a cargo structure selected from the plurality of cargo structures;

wherein the reservoir structure is formed as a bladder;

wherein the harness structure comprises a harness plate structure, a shoulder harness structure, a plurality of attachment structures, and a battery circuit;

wherein the shoulder harness structure attaches to the harness plate structure;

wherein a subset of the plurality of attachment structures attaches to the harness plate structure;

wherein the battery circuit mounts inside the harness plate structure.

2. The modular backpack and harness system according to claim 1 wherein the modular backpack and harness system is a luggage item;

wherein the modular backpack and harness system is a backpack;

wherein the modular backpack and harness system is a modular system;

wherein the modular backpack and harness system is interchangeable such that the modular backpack and harness system can be adjusted to the cargo being carried by the modular backpack and harness system.

3. The modular backpack and harness system according to claim 2 wherein the plurality of cargo structures are interchangeable;

wherein by interchangeable is meant that any first cargo structure selected from the plurality of cargo structures can be replaced by any second cargo structure selected from the plurality of cargo structures;

wherein the difference between any first cargo structure selected from the plurality of cargo structures and any second cargo structure selected from the plurality of cargo structures is the cargo the selected cargo structures are configured to carry.

4. The modular backpack and harness system according to claim 3 wherein the harness structure is a load bearing structure;

wherein the harness structure is a worn structure;

wherein the harness structure is worn on the back of an individual using the modular backpack and harness system;

wherein each cargo structure selected from the plurality of cargo structures removably attaches to the harness structure;

wherein each selected cargo structure attaches to the harness structure such that the harness structure is positioned between the back of the individual using the modular backpack and harness system and the selected cargo structure;

wherein the harness structure transfers the load of the selected cargo structure to an individual using the modular backpack and harness system.

5. The modular backpack and harness system according to claim 4 wherein the harness plate structure is a rigid structure;

wherein the harness plate structure is a disk shaped structure;

wherein any cargo structure selected from the plurality of cargo structures used by the individual using the modular backpack and harness system attaches to the harness plate structure;

wherein the harness plate structure comprises an anterior face, a posterior face, and a plurality of lateral faces;

wherein the anterior face forms a congruent end of the disk structure of the harness plate structure;

wherein the anterior face is the face of the disk structure of the harness plate structure with the greatest surface area;

wherein the anterior face is the face of the disk structure of the harness plate structure that is proximal to the individual using the modular backpack and harness system;

wherein the shoulder harness structure attaches to the anterior face of the harness plate structure;

wherein the posterior face forms a congruent end of the disk structure of the harness plate structure;

wherein the posterior face is the face of the disk structure of the harness plate structure that is distal from the anterior face;

wherein the posterior face forms the surface of the harness plate structure that any cargo structure selected from the plurality of cargo structures attaches to;

wherein a subset of the plurality of attachment structures attaches to the posterior face of the harness plate structure;

wherein the plurality of lateral faces form the lateral face structure of the disk structure of the harness plate structure;

wherein the plurality of lateral faces further comprises a superior lateral face, an inferior lateral face, a left lateral face, and a right lateral face;

wherein the superior lateral face is the horizontally oriented lateral face of the harness plate structure that forms the superior surface of the harness plate structure when the individual using the modular backpack and harness system wears the harness structure normally;

wherein the inferior lateral face is the horizontally oriented lateral face of the harness plate structure that is distal from the superior lateral face;

wherein the left lateral face is the vertically oriented lateral face of the harness plate structure that is proximal to the left side of the individual using the modular backpack and harness system when the harness structure is worn normally;

wherein the right lateral face is the vertically oriented lateral face of the harness plate structure that is distal from the individual using the modular backpack and harness system.

6. The modular backpack and harness system according to claim 5 wherein the shoulder harness structure is a harness;

wherein the shoulder harness structure attaches to the anterior face of the harness plate structure;

wherein the shoulder harness structure secures the harness plate structure to the individual using the modular backpack and harness system such that the anterior face of the harness plate structure is proximal to the individual using the modular backpack and harness system;

wherein a subset of the plurality of attachment structures further attaches to the shoulder harness structure.

7. The modular backpack and harness system according to claim 6 wherein the plurality of attachment structures combine to form a fastening device;

wherein the plurality of attachment structures removably attaches any cargo structure selected from the plurality of cargo structures to the harness plate structure and the shoulder harness structure;

wherein a subset of the plurality of attachment structures attaches to the posterior face of the harness plate structure;

wherein the balance of the plurality of attachment structures attaches to the shoulder harness structure.

8. The modular backpack and harness system according to claim 7 wherein the battery circuit is an electric circuit;

wherein the battery circuit is an electrochemical device;

wherein the battery circuit stores chemical potential energy;

wherein the battery circuit converts the chemical potential into electrical energy that is made available to the personal data device of the individual using the modular backpack and harness system;

wherein the battery circuit is an independently powered electric circuit;

wherein by independently powered is meant that the battery circuit can operate without an electrical connection to an external power source.

9. The modular backpack and harness system according to claim 8 wherein the shoulder harness structure comprises a left shoulder strap, a right shoulder strap, a waist strap, and a chest strap;

wherein the left shoulder strap is a shoulder strap;

wherein the shoulder strap is defined elsewhere in this disclosure;

wherein the left shoulder strap secures the harness structure to the left shoulder of the individual using the modular backpack and harness system;

wherein the right shoulder strap is a shoulder strap;

wherein the shoulder strap is defined elsewhere in this disclosure;

wherein the right shoulder strap secures the harness structure to the right shoulder of the individual using the modular backpack and harness system;

wherein the waist strap is a strap;

wherein the waist strap binds the harness structure to the waist of the individual using the modular backpack and harness system;

wherein the chest strap is a strap;

wherein the chest strap binds the harness structure to the chest of the individual using the modular backpack and harness system.

10. The modular backpack and harness system according to claim 9 wherein the plurality of attachment structures comprises a plurality of latch structures and a plurality of quick release buckles;

wherein the plurality of latch structures is a fastening device;

wherein the plurality of latch structures comprises a plurality of latch devices;

wherein the plurality of latch structures mount on the posterior face of the harness plate structure;

wherein the plurality of latch structures removably attach any cargo structure selected from the plurality of cargo structures to the posterior face of the harness plate structure;

wherein the plurality of quick release buckles is a fastening device;

wherein the plurality of quick release buckles comprises a plurality of quick release buckles;

wherein a subset of the plurality of quick release buckles attach to the shoulder harness structure;

wherein the balance of the plurality of quick release buckles attach to the posterior face of the harness plate structure;

wherein the plurality of quick release buckles removably attach any cargo structure selected from the plurality of cargo structures to the posterior face of the harness plate structure.

11. The modular backpack and harness system according to claim 10 wherein the battery circuit comprises a battery, a charging port, and a photovoltaic cell;

wherein the battery, the charging port, and the photovoltaic cell are electrically interconnected;

wherein the battery mounts in the interior of the harness plate structure;

wherein the charging port mounts in the left lateral face of the plurality of lateral faces of the harness plate structure;

wherein the photovoltaic cell mounts in the superior lateral face of the plurality of lateral faces of the harness plate structure.

* * * * *